US008739321B2

(12) United States Patent
Trout

(10) Patent No.: US 8,739,321 B2
(45) Date of Patent: Jun. 3, 2014

(54) AUTOMATIC TOILET SEAT OR LID LIFT APPARATUS AND METHODS OF USING THE SAME

(75) Inventor: William G. Trout, Elgin, IL (US)

(73) Assignee: Steelhead Inventions, LLC, Elgin, IL (US)

( * ) Notice: Subject to any disclaimer, the term of this patent is extended or adjusted under 35 U.S.C. 154(b) by 0 days.

(21) Appl. No.: 13/337,840

(22) Filed: Dec. 27, 2011

(65) Prior Publication Data

US 2012/0192341 A1 Aug. 2, 2012

Related U.S. Application Data

(60) Provisional application No. 61/436,754, filed on Jan. 27, 2011.

(51) Int. Cl.
*A47K 13/10* (2006.01)

(52) U.S. Cl.
USPC ..... 4/246.1; 4/241; 4/248

(58) Field of Classification Search
USPC ..... 4/246.1, 246.3, 246.4, 246.5, 241, 248, 4/667
See application file for complete search history.

(56) References Cited

U.S. PATENT DOCUMENTS

| | | | | | |
|---|---|---|---|---|---|
| 622,383 | A | * | 4/1899 | O'Brien | 4/241 |
| 1,681,277 | A | * | 8/1928 | Booth | 4/236 |
| 2,525,492 | A | * | 10/1950 | Leidy | 4/241 |
| 2,812,522 | A | * | 11/1957 | Wilson | 4/241 |
| 4,055,864 | A | * | 11/1977 | Liu et al. | 4/253 |
| 4,150,446 | A | | 4/1979 | Crocker | |
| 4,426,743 | A | * | 1/1984 | Seabrooke | 4/246.3 |
| 4,592,097 | A | * | 6/1986 | Zimmerman | 4/246.4 |
| 5,291,618 | A | | 3/1994 | Chiang | |
| 5,307,524 | A | * | 5/1994 | Veal | 4/246.1 |
| 5,323,496 | A | | 6/1994 | Blair | |
| 5,642,532 | A | * | 7/1997 | Morant | 4/246.1 |
| 5,794,277 | A | * | 8/1998 | Jones | 4/236 |
| 5,806,106 | A | * | 9/1998 | Carter et al. | 4/246.1 |
| 6,226,804 | B1 | | 5/2001 | Ballard | |
| 6,263,517 | B1 | | 7/2001 | Brooks | |
| 7,039,961 | B1 | | 5/2006 | Kirk | |
| 7,150,049 | B1 | * | 12/2006 | Fitch | 4/246.1 |
| 7,334,271 | B2 | | 2/2008 | Jung | |
| 2004/0172744 | A1 | | 9/2004 | Mills | |
| 2008/0189843 | A1 | | 8/2008 | Isaac | |

* cited by examiner

*Primary Examiner* — Huyen Le
*Assistant Examiner* — Erin Deery
(74) *Attorney, Agent, or Firm* — Scherrer Patent & Trademark Law, P.C.; Stephen T. Scherrer

(57) ABSTRACT

An automatic toilet seat or lid moving apparatus includes a common toilet seat or lid having a torsion spring or other counterbalance means to counterbalance the weight of a toilet seat or lid, and a motor for raising and/or lowering the toilet seat or lid when desired. A control is utilized for signaling the motor to raise and/or lower the toilet seat or lid. Methods of using the same are further provided.

8 Claims, 4 Drawing Sheets

AUTOMATIC TOILET SEAT OR LID LIFT APPARATUS AND METHODS OF USING THE SAME

The present invention claims priority to U.S. Provisional Patent App. No. 61/436,754, filed Jan. 27, 2011, and entitled, "Automatic Toilet Seat Lift Apparatus and Methods of Using the Same," the entirety of which is incorporated herein by reference in its entirety.

TECHNICAL FIELD

The present invention relates to an automatic toilet seat or lid moving apparatus. Specifically, a common toilet seat includes a torsion spring or other counterbalance means to counterbalance the weight of a toilet seat, and a motor for raising and/or lowering the toilet seat when desired. A control may be utilized for signaling the motor to raise and/or lower the toilet seat. Methods of using the same are further provided.

BACKGROUND

It is, of course, generally known to utilize toilets when eliminating bodily waste, such as feces and/or urine. Typically, a user of a toilet must manipulate the toilet seat to properly utilize the toilet. For example, a toilet typically includes a toilet lid, and a toilet seat having an opening in the middle thereof. When necessary for sitting, a user generally sits on the toilet seat and evacuates waste into the basin of the toilet. A user of a toilet typically encounters a toilet with both the lid and the seat, or at least the seat in a downwardly disposed position. The user would then be required to lift the toilet lid, if the toilet seat is desired, or lift both the toilet lid and the toilet seat if sitting on the toilet seat is not desired. For example, if the user of the toilet was male and had to urinate, the user of the toilet would lift both the toilet lid and the toilet seat (or simply the toilet seat if no toilet lid was present) to expose the basin of the toilet, thereby minimizing the contact of urine with the toilet seat. Alternatively, if the user is female, or if the user is male and had to sit on the toilet seat, only the toilet lid would be required to be manipulated, thereby leaving the toilet seat for sitting thereon. In other cases, the toilet seat may be in a raised position, and it may be necessary to manipulate the toilet seat downwardly so as to be able to sit on the toilet seat or to close the seat and/or the lid.

Typically, toilet lids and toilet seats are pivoted devices, hinged at a base thereof for moving of the lid and/or the seat when necessary. Typically, when disposed upwardly away from the toilet basin, the lid and/or the seat remains in an upright position, typically being stopped by the toilet tank.

Toilet seats and/or lids, however, may be unsanitary. It is typical for a toilet to be used by many different individuals. When seated, a user's bare posterior typically contacts the toilet seat, and the toilet seat may, therefore, have a surface for the spread of microbes from one user of the toilet seat to another. It is estimated that a toilet seat contains about 50 germs per square inch, and that only 10 to 100 viral particles per square inch are necessary for the average person to contract a disease.

Moreover, each time a toilet flushes, the cascade of water through the toilet basin from the tank may throw microbes in all directions. It is also estimated that microbes may float around a bathroom for up to two hours after each flush, and thus it is recommended that toilet seats and lids be disposed over the basin so as to cover the same and minimize the spread of pathogens.

A need, therefore, exists for an apparatus and methods of using the same for manipulation of a toilet seat for raising and/or lowering the same to minimize contact between a user and the toilet seat. Moreover, a need exists for an apparatus and methods of using the same for decreasing the likelihood of disease transfer caused by pathogens on a toilet seat.

Moreover, many users of toilet seats are elderly and/or disabled, and the task of lifting a toilet seat for use thereof may not be simple or easy. For example, raising and/or lowering a toilet seat may require an individual to bend his or her back to grasp the toilet seat. For many people, even this simple task is or is nearly impossible. Moreover, although toilet seats are or may be relatively light, in many cases, they may still be too heavy for an individual to raise and or lower effectively.

A need, therefore, exists for an apparatus and methods of using the same allowing a user that may have difficulty manipulating a toilet seat. Moreover, a need exists for an apparatus and methods of using the same providing easier raising and/or lowering of the toilet seat by a user thereof.

Automatic toilet seat lifters or movers are generally known in the art. Specifically, it is generally known to utilize a lever or a motor for lifting a toilet seat and/or a toilet lid. However, relatively heavy duty and cumbersome levers and/or motors must be utilized, because toilet lids and/or toilet seats may be difficult to lift and/or lower effectively, due to the weight of the toilet lids and seats. This is so because the toilet lids and seats are pivoted, and rotated on a hinge or plurality of hinges at the lids' and/or seats' bases. A motor, to be effective, must be, by necessity, out of the way of a user who wishes to utilize the toilet. Thus, a lever and/or a motor that may be utilized to lift or lower a toilet lid and/or seat is typically disposed toward the hinge at or near a location where the toilet lid and/or seat has the least torque. A relatively large and cumbersome lever and/or motor must typically be used, requiring high energy consumption and a very powerful motor for lifting the lid and/or the seat.

Therefore, a need exists for an apparatus and methods of using the same for minimizing the size of the motor required to lift and/or lower the lid and/or seat. Specifically, a need exists for an apparatus and methods of using the same for effectively counterbalancing the weight of the lid and/or the seat for allowing a relatively small motor to be utilized for lifting and/or lowering the lid and/or seat.

SUMMARY OF THE INVENTION

The present invention relates to an automatic toilet seat or lid moving apparatus. Specifically, a common toilet seat or lid includes a torsion spring or other counterbalance means to counterbalance the weight of a toilet seat or lid, and a motor for raising and/or lowering the toilet seat or lid when desired. A control may be utilized for signaling the motor to raise and/or lower the toilet seat or lid. Methods of using the same are further provided.

To this end, in an embodiment of the present invention, an apparatus for raising or lowering a toilet lid is provided. The apparatus comprises a rotating mechanism; an axle, the axle rotated via the rotating mechanism; a bracket for interconnecting the axle with a toilet lid, the bracket pivoting on a pivot point via rotation of the axle; and a torsion spring for reducing the force required to pivot the bracket when the bracket is attached to a toilet lid.

In an embodiment, the rotating mechanism is driven by an apparatus selected from the group consisting of a motor and a piston.

In an embodiment, the apparatus further comprises a control electronically connected to the rotating mechanism for remotely controlling the rotating mechanism, wherein the control is interconnected to the rotating mechanism via a connection selected from the group consisting of a wired and a wireless connection.

In an embodiment, the torsion spring is interconnected with the axle.

In an embodiment, the torsion spring is adjustable to change the tension of the torsion spring.

In an embodiment, the apparatus further comprises a base plate for mounting the apparatus to a toilet, the base further having apertures for receiving toilet lid mounts.

In an embodiment, the base is mountable to a plurality of sizes of toilet lid mounts.

In an embodiment, the distance between the apertures is adjustable to accommodate different sizes of toilet lid mounts.

In an alternate embodiment of the present invention, a toilet lid moving system is provided. The toilet lid moving system comprises a toilet lid having a weight; a toilet lid lifting apparatus comprising a rotating mechanism, an axle rotated via the rotating mechanism, a bracket for interconnecting the axle with the toilet lid and pivoting on a pivot point via rotating of the axle, and a torsion spring for reducing the force required to pivot the bracket when the bracket is attached to the toilet lid.

In an embodiment, the rotating mechanism is driven by an apparatus selected from the group consisting of a motor and a piston r.

In an embodiment, the apparatus further comprises a control electronically connected to the rotating mechanism for remotely controlling the rotating mechanism, wherein the control is interconnected to the rotating mechanism via a connection selected from the group consisting of a wired and a wireless connection.

In an embodiment, the torsion spring is interconnected with the axle.

In an embodiment, the torsion spring is adjustable to change the tension of the torsion spring, thereby adjusting the force required to rotate the bracket depending on the weight of the toilet lid.

In an embodiment, the toilet lid moving apparatus further comprises a base plate for mounting the apparatus to a toilet, the base further having apertures for receiving toilet lid mounts.

In an embodiment, the base plate is mountable to a plurality of sizes of toilet lid mounts.

In an embodiment, the distance between the apertures is adjustable to accommodate different sizes of toilet lid mounts.

In an alternate embodiment of the present invention, a method of moving a toilet lid is provided. The method comprises the steps of providing a toilet lid having a weight disposed on a toilet basin and hinged to pivot upwardly and downwardly; providing a toilet lid moving apparatus comprising a rotating mechanism, an axle rotated via the rotating mechanism, a bracket for interconnecting the axle with the toilet lid and pivoting on a pivot point via rotating of the axle, and a torsion spring for reducing the force required to pivot the bracket when the bracket is attached to the toilet lid; moving the rotating mechanism to pivot the bracket about the pivot point; and moving the toilet lid upwardly or downwardly via the bracket.

In an embodiment, the torsion spring is interconnected with the axle.

In an embodiment, the method further comprises the step of adjusting the torsion spring to change the force required to pivot the bracket depending on the weight of the toilet seat.

In an embodiment, the method further comprises the step of providing a base plate wherein the toilet lid moving apparatus is mounted to the base plate; providing a plurality of apertures for receiving mounts of the toilet lid; and adjusting the apertures to fit the mounts of the toilet lid.

It is, therefore, an advantage of the present invention to provide an apparatus and methods of using the same for manipulation of a toilet seat for raising and/or lowering the same to minimize contact between a user and the toilet seat.

Moreover, it is an advantage of the present invention to provide an apparatus and methods of using the same for decreasing the likelihood of disease transfer caused by pathogens on a toilet seat.

In addition, it is an advantage of the present invention to provide an apparatus and methods of using the same allowing a user to utilize the toilet seat that otherwise may have difficulty manipulating the same with his or her hands.

It is also an advantage of the present invention to provide an apparatus and methods of using the same providing easier raising and/or lowering of the toilet seat by a user thereof.

Further, it is an advantage of the present invention to provide an apparatus and methods of using the same for minimizing the size of the motor required to lift and/or lower the lid and/or seat.

Still further, it is an advantage of the present invention to provide an apparatus and methods of using the same for effectively counterbalancing the weight of the lid and/or the seat for allowing a relatively small motor to be utilized for lifting and/or lowering the lid and/or seat.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to an automatic toilet seat moving apparatus. Specifically, a common toilet seat or lid includes a torsion spring or other counterbalance means to counterbalance the weight of a toilet seat, and a motor for raising and/or lowering the toilet seat when desired. A control may be utilized for signaling the motor to raise and/or lower the toilet seat. Methods of using the same are further provided.

Figure 1:
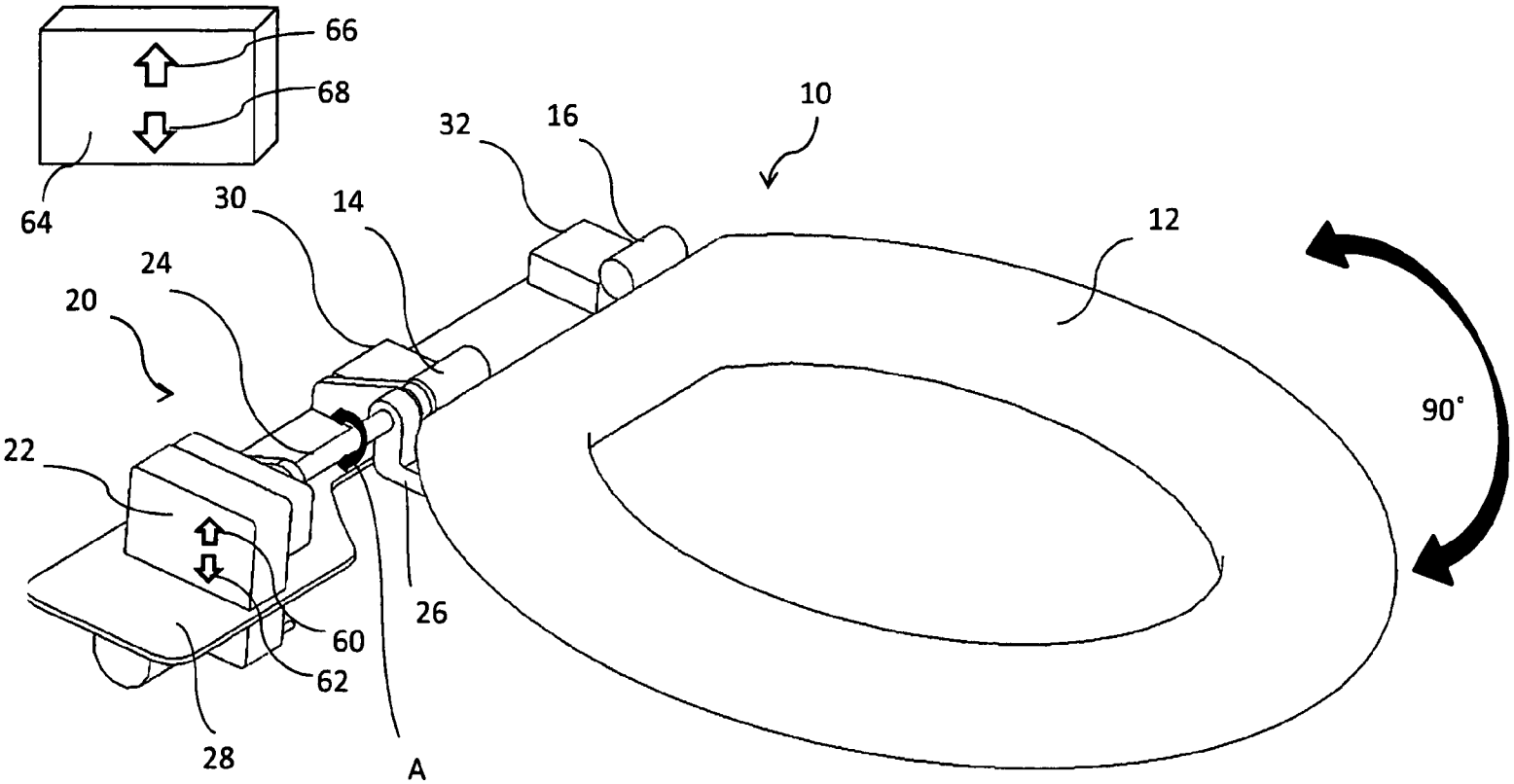
FIG. 1 illustrates a perspective view of a toilet lid and a toilet lid lift apparatus in an embodiment of the present invention.

Referring now to the figures, wherein line numerals refer to like parts, FIG. 1 illustrates a perspective view of a toilet lid lifting system 10 in an embodiment of the present invention. Although the present invention is described as a "lifting" system, it should be noted that the term "lifting" is meant to encompass both the raising and/or lowering of the toilet lid according to the present invention. The toilet lid lifting system 10 comprises a toilet lid 12 having hinges 14, 16 and a toilet lid lifting apparatus 20. The toilet lid 12 may sit upon a toilet and may lift as normal, as apparent to one of ordinary skill in the art. Specifically, the toilet lid 12 may sit upon a toilet basin, and may be disposed downwardly on the toilet basin when in use, or pivoted via hinges 14, 16 to lift the toilet lid 12 out of the way if being used by an individual requiring the toilet seat to be lifted, such as a male during urination. As shown in FIG. 1, the toilet lid 12 may lift about 90° via hinges 14, 16 onto or off from a toilet basin (not shown).

The toilet lid lifting apparatus 20 may comprise a plurality of components, such as a motor 22 for turning an axle 24, and a lifting bracket 26 that may be connected to the axle 24 and the toilet lid 12. In use, the motor 22 may turn the axle 24, thereby rotating the lifting bracket 26, which may pivot the toilet seat 12 upwardly or downwardly via hinges 14, 16. Preferably, the motor 22 may turn the axle 24 about 90°, as shown in FIG. 1, represented by arrows A. Although the present invention is described with reference to the toilet lid 12, it should be noted that the apparatus of the present invention may be utilized with a toilet seat, either separately with another lifting apparatus as described herein or together with a single apparatus. The term "toilet seat" and "toilet lid" may, thus, be interchanged without detracting from the invention. For purposes of the present invention, reference to a toilet lid means either or both of the toilet seat and/or a toilet lid.

The motor 22 may be any motor useful for rotating the axle 24, and may be powered via AC or DC power, as apparent to one of ordinary skill in the art. The motor 22 may further be connected to axle 24 via a plurality of step down gears, such that the rotation of the motor may be stepped down to accommodate the speed and torque necessary for rotating the axle 24 and lifting the toilet lid 12, as described below. It should be noted that any mechanical means may be utilized for rotating the axle 24 as apparent to one of ordinary skill in the art, including, for example, the motor as described herein, a piston or linear actuator driven by a solenoid in a back and forth arrangement. For example, a piston or linear actuator may be interconnected, through a plurality of hinged arms to rotate the axle 24 as needed to raise and/or lower the toilet lid 12.

Preferably, the motor 22 may have sufficient rotating motion to raise and/or lower the toilet lid 12 via the axle 24 and the bracket 26 such that the toilet lid 12 only moves within an up position and a down position, as needed. Thus, the motor 22 may have limit switches or other programmable limits to ensure that the motor 22 does not move the toilet lid 12 beyond what is necessary to raise and/or lower the toilet lid 12.

The bracket 26 may preferably be an L-shaped bracket having a pivot point attached to the axle 24 on a first leg of the L-shaped bracket. Rotation of the axle 22 causes rotation of the bracket 26 at the pivot point. The other leg of the L-shaped bracket may be rigidly held to the toilet lid 12, such that rotation of the bracket 26 about the pivot point causes movement of the toilet lid 12, either raising or lowering the toilet lid 12.

Figure 5:
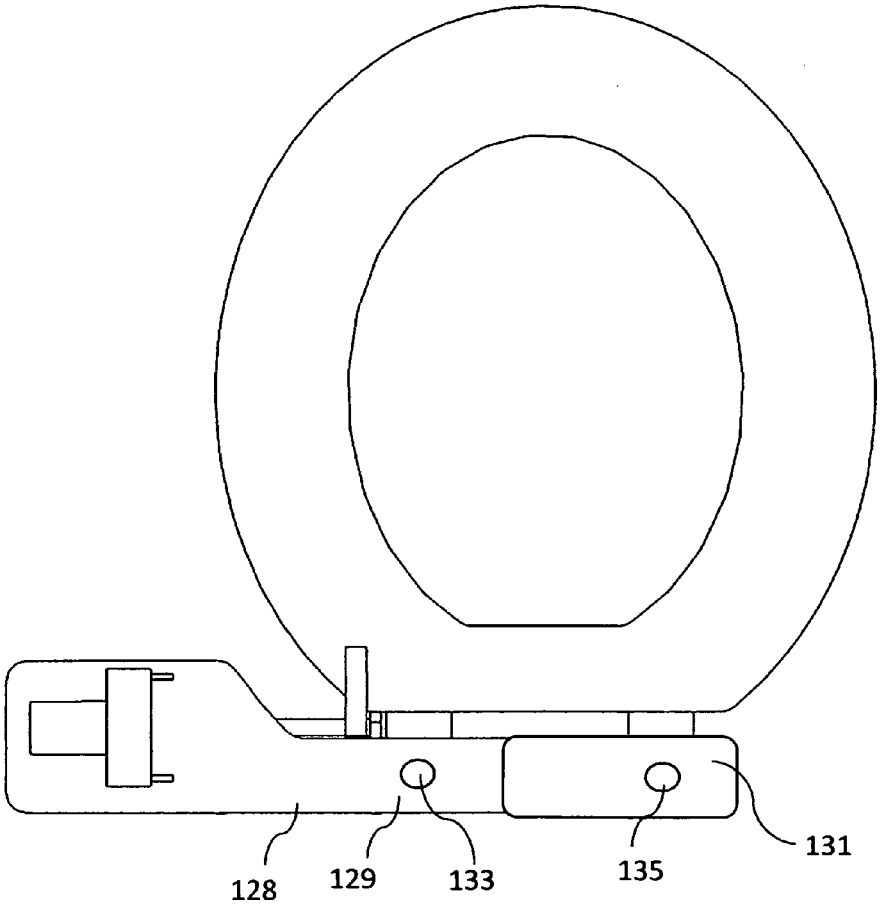
FIG. 5 illustrates a bottom view of a toilet lid and toilet lid lift apparatus having a slidably adjustable portion in an embodiment of the present invention.

The toilet lid lifting apparatus 20 may be mounted on a base plate 28 that may be disposed on the toilet, and may rigidly hold the components of the toilet lid lifting apparatus 20 to the toilet. As illustrated in FIG. 1, the mounts 30, 32 of the toilet lid 12 may be disposed through the base plate 28 and may rigidly hold the base plate 28 to the toilet. Preferably, the base plate 28 may contain a plurality of apertures for the mounts 30, 32 to be disposed therethrough. In a preferred embodiment, the base plate 28 may allow different types of toilet lid mounts 30, 32 to be utilized, such as different sizes thereof, allowing the toilet lid lifting apparatus to be, generally, universal for all toilet lids. For example, the apertures may be relatively wide slots that allow the mounts 30, 32 a degree of freedom to be mounted through the base plate 28. Alternatively, the base plate 28 may be comprised of two slidable components (129, 131 of base plate 128, as illustrated in FIG. 5) that allow alternate positioning of the apertures for the mounts 30, 32 to be disposed through apertures 133, 135.

Figure 2:
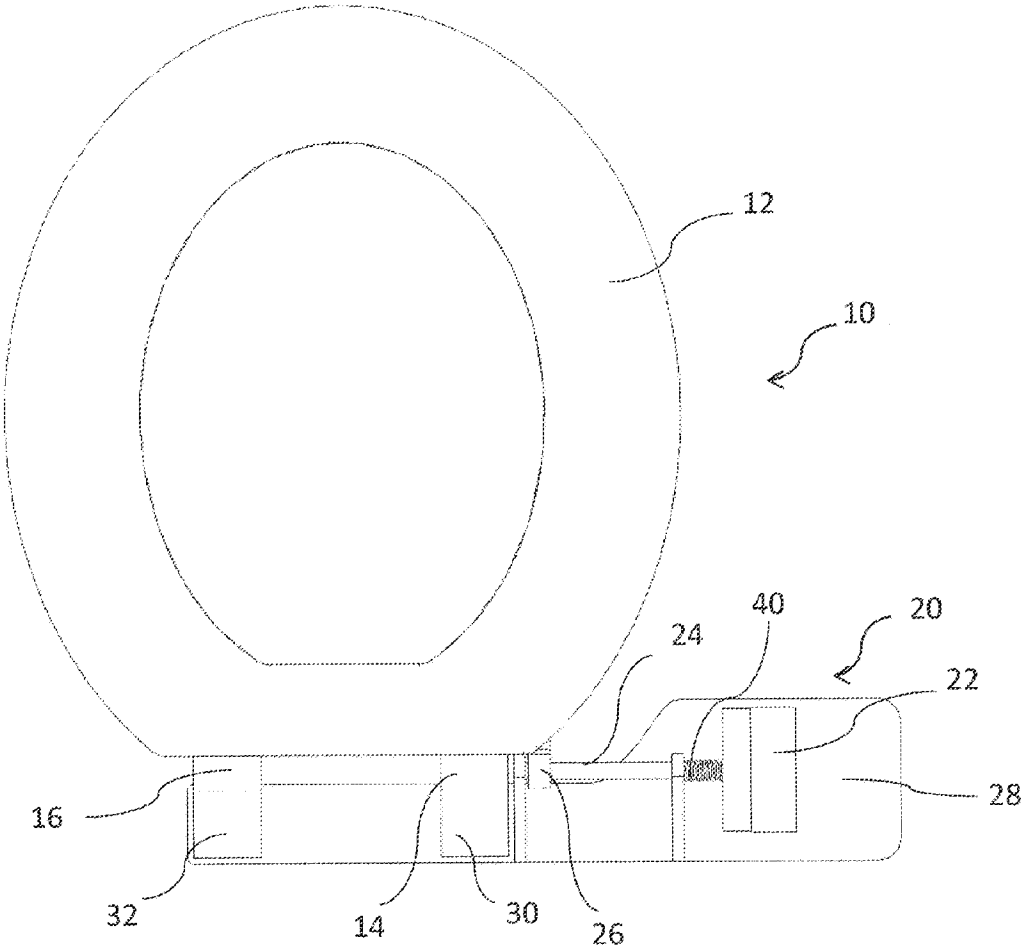
FIG. 2 illustrates a top view of a toilet lid and toilet lid lift apparatus in an embodiment of the present invention.

The toilet lid lifting apparatus 20 is shown in further detail in FIG. 2, which illustrates a top view of the toilet lid lifting apparatus 20 and toilet lid 12. As illustrated, the motor 22 interconnects to an axle 24, which pivots a bracket 26, thereby raising and/or lowering the toilet lid 12. Disposed on the axle 22 may be a torsion spring 40, mounted to a mounting base and interconnected with the axle 24. The torsion spring 40 may provide a counterbalancing force to the axle 24 and, therefore, the bracket 26 that may counteract the weight of the toilet lid 12. Specifically, the force required to lift the toilet lid 12 may be such that it may be difficult for the motor 22 or other like mechanical means to raise and/or lower the toilet lid 12. Therefore, the torsion spring may lessen the force required to raise and/or lower the toilet lid 12, thereby easing the strain on the motor 22. In an embodiment, the torsion spring 40 reduces the effect of the weight of the toilet lid 12 driven by the motor 22. In a preferred embodiment, the torsion spring 40 eliminates or effectively eliminates the weight of the toilet lid 12, eliminating or reducing the effect that the weight of the lid may have on the motor 22.

Although the embodiment shown herein illustrates the torsion spring 40 disposed on the axle 24, it should be noted that the torsion spring 24 may be in any location that allows the reduction or elimination of the effect of the weight of the toilet lid 12 on the motor 22. For example, the torsion spring may be mounted to the toilet below the toilet lid 12 and may be directed connected, on one end of the spring, to the toilet lid, counteracting the effect of the weight of the toilet lid 12.

Figure 3:
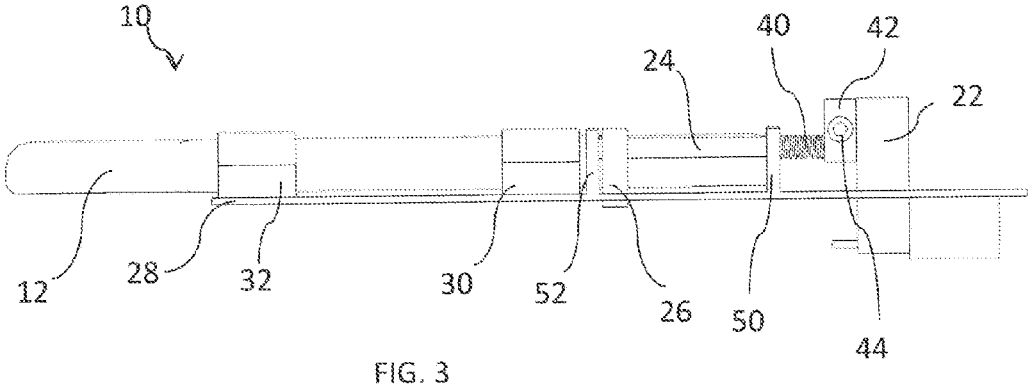
FIG. 3 illustrates a rear view of a toilet lid and toilet lid lift apparatus in an embodiment of the present invention.

FIG. 3 illustrates a rear view of the toilet lid lift apparatus 20 connected to the toilet lid 12. As illustrated, the torsion spring 40 may be mounted to the axle 24, and held in place via holders 50, 52 that may extend from the base plate 28 to hold the axle relatively parallel to the base plate 28, but in line with the pivot point of the hinges 14, 16 of the toilet lid 12. The torsion spring 40 may be mounted to the axle 40 within block 42, which may allow the torsion spring 40 to be adjusted via the bolt 44. Specifically, turning the bolt 44 may tighten or loosen the torsion spring 40 such that the torsion spring's spring constant may change, thereby allowing the torsion spring 40 to be adjustable, depending on the weight of the toilet lid 12. In other words, the torsion spring 40 may be adjusted to accommodate a variety of toilet lids with different weights. For example, tightening the bolt 44 may tighten the tension of the torsion spring 40 so that the torsion spring 40 may accommodate a relatively heavy toilet lid. Alternatively, the tension of the torsion spring 40 may be loosened by turning the bolt 44 in an opposite direction, thereby accommodating a relatively light toilet lid.

In a preferred embodiment of the present invention, the torsion spring 40 may be adjustable so that increasing the tension of the torsion spring 40 may allow the torsion spring to accommodate toilet lids having different weights. For example, for a relatively heavy toilet lid, the tension of the torsion spring 40 may be tightened to provide additional counterbalancing effect to make it easier to lift the relatively heavy toilet lid. Alternatively, a toilet lid may be relatively light, and the tension of the torsion spring 40 may be loosened to lessen the counterbalancing effect. To adjust the spring, bolt 44 may be turned, thereby turning a spring torque drive (not shown) within the block 42. An end of the torsion spring 40 may be attached to the spring torque drive within the block 42, and turning of the spring torque drive via the bolt 44 may cause the tension on the torsion spring 40 to tighten or loosen, depending on the direction of rotation of the bolt 44. The other end of the torsion spring 40 may be rigidly connected to the axle 24, or otherwise to the bracket 26, to aid in counterbalancing the weight of the toilet lid 12 when the bracket 26 pivots via rotation of the axle 24.

Figure 4:
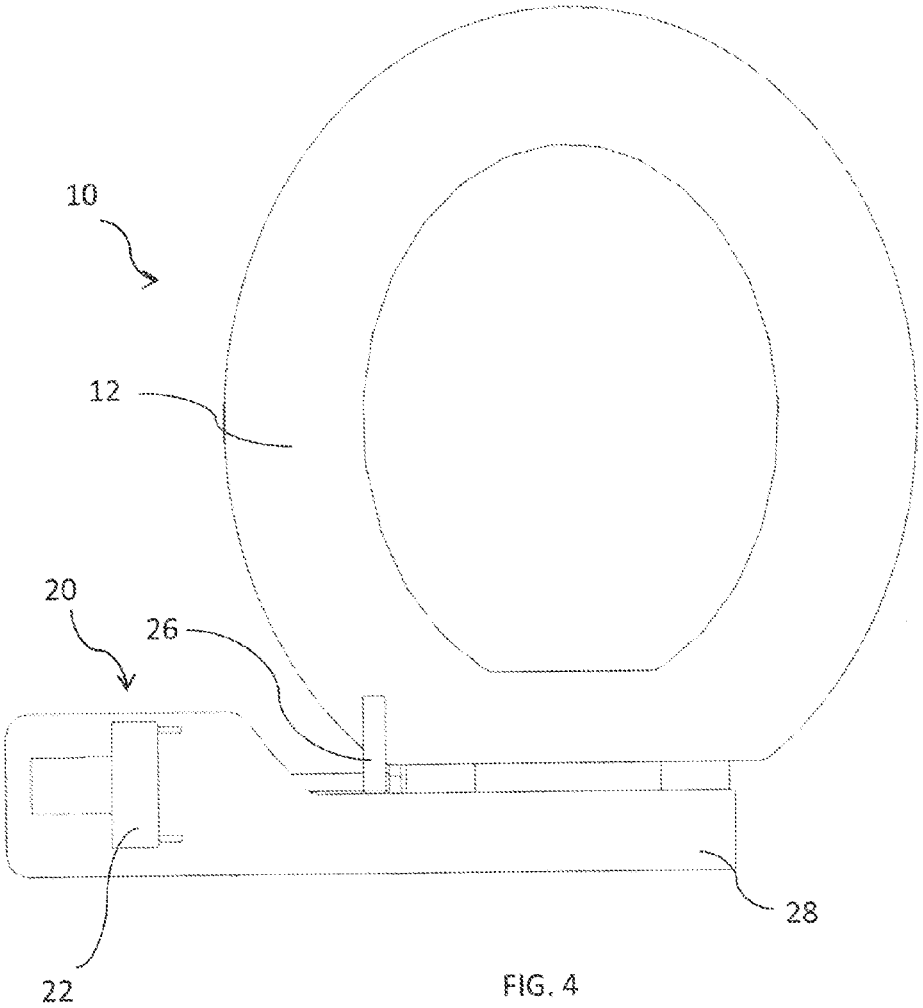
FIG. 4 illustrates a bottom view of a toilet lid and toilet lid lift apparatus in an embodiment of the present invention.

Referring now to FIG. 4, a bottom view of the toilet lid lift apparatus 20 is illustrated with toilet lid 12. The bracket 26 is shown rigidly held to the bottom of the toilet lid 12. Therefore, rotation of the axle 24, with the aid of the torsion spring 40, may allow the toilet lid 12 to be raised and/or lowered via rotation of the bracket 26, as described above.

As illustrated, the toilet lid lifting apparatus 20 may be configured in a manner whereby the motor 22 and other components are generally out of the way of the proper functioning of the toilet lid 12. For example, the motor 22 may jut from the side of the toilet lid lifting apparatus to be disposed to the side of the toilet lid 12. It should be noted that the configuration of the toilet lid lifting apparatus is not to be limited as described herein. Moreover, the components of the toilet lid lifting apparatus 20 may be enclosed within an enclosure or sheath to protect the components thereof from environmental contaminants, such as urine, water, dirt, cleaning solution or other like materials that may interfere with the proper functioning of the toilet lid lifting apparatus 20.

Disposed in a location accessible to a user of the toilet lid lift apparatus 12 may be a control having an up button and a down button. When necessary for use, a user may push the up button which may send a signal to the motor 22, either wired (via "up" button 60 on the motor 22 of FIG. 1) or wirelessly (via "up" button 66 on wireless control 64), for raising the toilet lid 12. When necessary, a user may push the down button to send a signal to the motor 22, again either wired (via "down" button 62 on the motor 22 of FIG. 1) or wirelessly (via "down" button 68 on wireless control 64), for lowering the toilet lid 12. The control may have push buttons, dials, switches, or any other mechanism for signaling to the motor 22 to raise and/or lower the toilet seat 18, as necessitated by a user thereof. The control, and the motor 22, may be battery powered, such that DC will effectively power the same. Alternatively, the control and the motor 22 may be hardwired to the electrical grid, thereby powered by AC electricity, as is known to those of ordinary skill in the art.

Alternatively, the control may have logic circuitry for raising and/or lowering the toilet lid 12 upon predetermined conditions. For example, the toilet lid 12 may be automatically lowered upon flushing the toilet. Alternatively, the control may sense the presence of an individual and automatically raise a lid (if present) and/or seat, as necessary.

In addition, it should be noted that the torsion spring, as described herein, may be constructed in such a way as to change its tension with the position of the toilet seat and/or toilet lid. For example, when the toilet seat or toilet lid is barely above toilet, it may have an effective weight that is higher than the toilet seat at a nearly upright position. Thus, the torsion spring may change its tension to account for this change in effective weight of the toilet seat or lid at various positions.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. An apparatus for raising or lowering a toilet lid, said toilet lid having a weight, comprising:

a rotating mechanism comprising a motor;

an axle, the axle rotated via the rotating mechanism;

a bracket connected to the axle and contacting the toilet lid for interconnecting the axle with the toilet lid, the bracket pivoting on a pivot point via rotation of the axle thereby moving the toilet lid between a down position and an up position via rotation of the axle;

a torsion spring interconnected with the axle, said torsion spring neutralizing the weight of the toilet lid so that the toilet lid may be placed in any position between an up position and a down position without movement due to gravity or bias caused by the torsion spring, said torsion spring further reducing the force required to pivot the bracket with the motor upwardly and downwardly when the bracket is attached to a toilet lid, said torsion spring adjustable to increase or decrease the tension of the torsion spring on the axle for neutralizing the weight of the toilet seat, no matter the weight of the toilet seat; and an elongated, flat base plate for mounting the apparatus to a toilet, the base plate further having apertures for receiving pivoting toilet lid mounts, the base plate positionable beneath the toilet lid, the toilet lid mounts mountable through the apertures.

2. The apparatus of claim 1 further comprising a control electronically connected to the rotating mechanism for remotely controlling the rotating mechanism, wherein the control is interconnected to the rotating mechanism via a connection selected from the group consisting of a wired and a wireless connection.

3. The apparatus of claim 1 wherein the base plate is mountable to a plurality of sizes of toilet lid mounts.

4. A toilet lid moving system comprising:

a toilet;

a toilet lid having a weight, the toilet lid mounted to the toilet via pivoting toilet lid mounts; and a toilet lid moving apparatus comprising a rotating mechanism, wherein the rotating mechanism comprises a motor, an axle rotated via the rotating mechanism, a bracket connected to the axle and to a toilet lid for interconnecting the axle with the toilet lid and pivoting on a pivot point via rotation of the axle thereby moving the toilet lid between a down position and an up position, a torsion spring interconnected with the axle, said torsion spring neutralizing the weight of the toilet lid so that the toilet lid may be placed in any position between an UP position and a down position without movement due to gravity or bias caused by the torsion spring, said torsion spring further reducing the force required to pivot the bracket with the motor upwardly and downwardly when the bracket is attached to the toilet lid, the torsion spring adjustable to increase or decrease the tension of the torsion spring on the axle for neutralizing the weight of the toilet seat, no matter the weight of the toilet seat, and an elongated, flat base plate for mounting the apparatus to a toilet, the base plate further having apertures for receiving the pivoting toilet lid mounts, the base plate positioned beneath the toilet lid, the pivoting toilet lid mounts mounted through the apertures.

5. The system of claim 4 further comprising:

a control electronically connected to the rotating mechanism for remotely controlling the rotating mechanism, wherein the control is interconnected to the rotating mechanism via a connection selected from the group consisting of a wired and a wireless connection.

6. The system of claim 5 wherein the base plate is mountable to a plurality of sizes of toilet lid mounts.

7. A method of lifting a toilet lid comprising the steps of:

providing a toilet lid having a weight disposed on a toilet basin and hinged to pivot upwardly and downwardly via pivoting toilet lid mounts;

providing a toilet lid moving apparatus comprising a rotating mechanism comprising a motor, an axle rotated via the rotating mechanism, a bracket connected to the axle and the toilet lid and pivoting on a pivot point via rotation of the axle thereby moving the toilet lid between a down position and an up position, a torsion spring interconnected with the axle, said torsion spring neutralizing the weight of the toilet lid so that the toilet lid may be placed in any position between an uP position and a down position without movement due to gravity or bias caused by the torsion spring, said torsion spring further reducing the force required to pivot the bracket upwardly and downwardly with the motor when the bracket is attached to the toilet lid and a flat, elongated base plate for mounting the apparatus to a toilet, the base plate further having apertures for receiving the pivoting toilet lid mounts, the base plate positioned beneath the toilet lid, the toilet lid mounts mounted through the apertures;

adjusting the tension of the torsion spring to increase or decrease the tension of the torsion spring on the axle for neutralizing the weight of the toilet seat, no matter the weight of the toilet seat moving the rotating mechanism to pivot the bracket upwardly and downwardly about the pivot point; and moving the toilet lid upwardly or downwardly via the bracket.

8. The method of claim 7 further comprising the step of:

adjusting the torsion spring to increase or decrease the tension of the torsion spring on the axle.

* * * * *